US006241808B1

(12) United States Patent
Morioka et al.

(10) Patent No.: US 6,241,808 B1
(45) Date of Patent: Jun. 5, 2001

(54) PRODUCTION OF IRON ORE PELLETS

(75) Inventors: Koichi Morioka; Jyunpei Kiguchi, both of Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 09/385,850

(22) Filed: Aug. 30, 1999

(30) Foreign Application Priority Data

Sep. 8, 1998 (JP) ..... 10-254024

(51) Int. Cl.[7] ..... C22B 1/16
(52) U.S. Cl. ..... 75/768; 75/322; 75/751
(58) Field of Search ..... 75/322, 751, 765, 75/768

(56) References Cited

U.S. PATENT DOCUMENTS 3,536,475 10/1970 Trub .
3,980,465 * 9/1976 Nishida et al. ..... 75/3
4,684,549 * 8/1987 Allen et al. ..... 427/221

* cited by examiner

*Primary Examiner*—Melvyn Andrews
(74) *Attorney, Agent, or Firm*—Oblon, Spivak, McClelland, Maier & Neustadt, P.C.

(57) ABSTRACT

A process for producing fired pellets by granulating finely-ground iron ore and subjecting the resulting granules sequentially to drying, dehydration, preheating, and firing, wherein said process comprises adding an additive to said finely-ground iron ore at the time of granulation, said additive reacting with iron ore to form a compound which has a melting point lower than the preheating temperature. Owing to the additive (or sintering auxiliary) added in a small amount to iron ore powder, it is possible to produce preheated pellets by using the existing grate kiln without increasing the amount of preheating energy. The resulting preheated pellets have improved strength and produce no adverse effect on finished pellets.

4 Claims, 4 Drawing Sheets

PRODUCTION OF IRON ORE PELLETS

BACKGROUND OF THE INVENTION

1. Field of the Invention

The present invention relates to a process for producing iron ore pellets and, more particularly, to a process for producing iron ore pellets from raw materials containing iron ore with a high content of crystal water.

2. Description of the Prior Art

Production of iron ore pellets by the grate kiln system involves the steps of forming spherical green pellets (9.5–11 mm in diameter), drying and preheating them (in layers about 30 cm thick) in the travelling grate to impart prescribed strength to them, firing the preheated pellets at 1250–1350° C. in the firing rotary kiln, and finally cooling the fired pellets in the cooler. In this way there are obtained iron ore pellets to be used in the blast furnace.

For the efficient production of high-quality pellets by the grate kiln system mentioned above, it is necessary to charge the rotary kiln with preheated pellets which have been given prescribed crushing strength by complete heat treatment in the travelling grate. The travelling grate will be operated under different conditions depending on the kind of iron ore; therefore, the productivity and quality are variable. For example, the operating time would be shorter and the preheating temperature would be higher for magnetite than for hematite (because the former generates heat by oxidation at 700° C. and above).

Usually, the travelling grate consists of three zones—drying, dehydrating, and preheating zone. The drying zone is designed to remove water from green pellets at 180–250° C., the dehydrating zone is designed to remove 1–3% of crystal water at 250–400° C., and the preheating zone is designed to give pellets crushing strength sufficient for them to withstand tumbling firing in the rotary kiln at about 1000° C. In this way, preheated pellets are produced.

The continued high steel production has led to the mining of iron ore at deeper deposits than before. Iron ore mined at deep deposits contains more crystal water. Such iron ore poses a problem when it is made into pellets by the grate kiln. In other words, particles of iron ore with a high content of crystal water shrink when green pellets are dehydrated and preheated. As the result, preheated pellets increase in porosity, with reduced bonding between particles, and decrease in strength. In addition, removing crystal water needs a large amount of reaction heat, which leads to a decrease in pellet temperature. To compensate for this, it is necessary to supply additional heat energy for preheating and firing.

Preheated pellets with reduced strength largely become powder during firing in the rotary kiln, which leads to low yields and gives rise to kiln rings.

Several methods have been proposed as follows to improve the strength of preheated pellets.

(a) Raising the preheating temperature and/or prolonging the preheating time for green pellets. This decreases the pellet porosity and promotes bonding between iron ore particles.

(b) Incorporating iron ore powder with finely divided bentonite. This promotes the granulation of green pellets, thereby decreasing the pellet porosity.

(c) Incorporating iron ore powder with an organic binder such as cellulose. This promotes the granulation of green pellets, thereby decreasing the pellet porosity.

Unfortunately, method (a) suffers the disadvantage of requiring renovation of production facilities for increased heat resistance and also requiring additional fuel for preheating, which leads to a cost increase. Method (b) suffers the disadvantage of requiring a large amount of bentonite powder, which leads to a cost increase and degraded pellets. Method (c) also suffers the disadvantage of requiring a large amount of organic binder, which not only increases production cost but also deteriorates the strength of pellets because any organic binder burns to form voids during preheating and firing, thereby increasing porosity.

OBJECT AND SUMMARY OF THE INVENTION

The present invention was completed to address the above-mentioned problems. Thus it is an object of the present invention to provide a process for producing good iron ore pellets from raw materials with a high content of crystal water by using the existing grate kiln facility. According to the present invention, this object is achieved by adding a small amount of specific additive (sintering auxiliary) to iron ore powder. This additive increases the strength of preheated pellets without requiring additional preheating energy and producing any adverse effect on the quality of finished pellets.

DESCRIPTION OF THE PREFERRED EMBODIMENTS

Figure 1:
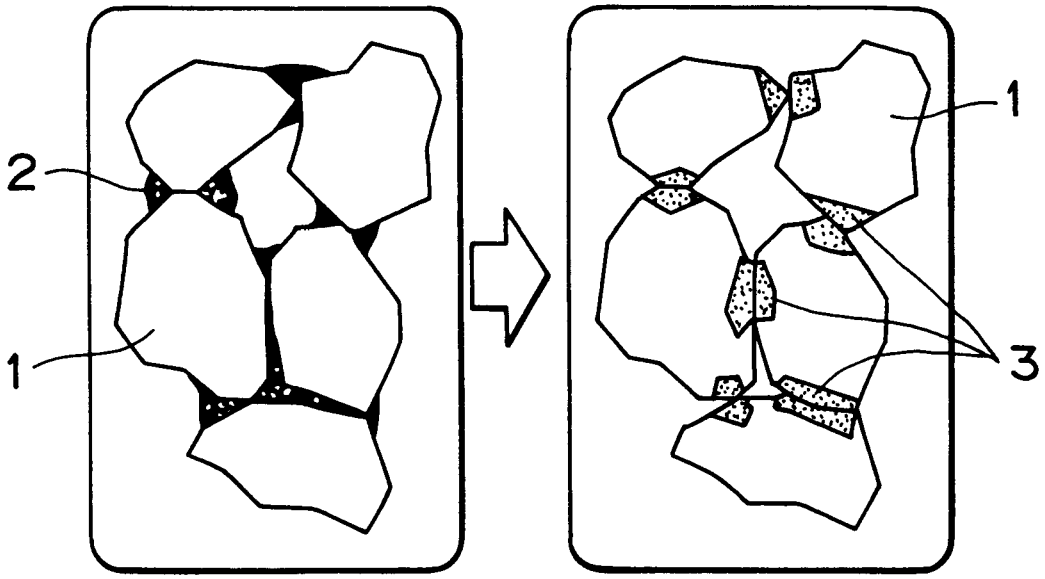
FIG. 1 is a schematic diagram showing how the liquid-phase sintering of iron ore powder takes place according to the present invention. Part (a) shows green pellets (in dry state) incorporated with an additive. Part (b) shows iron ore powder which has undergone liquid-phase sintering.

The present invention covers a process for producing fired pellets by granulating finely-ground iron ore and subjecting the resulting granules sequentially to drying, dehydration, preheating, and firing, wherein said process comprises adding an additive to said finely-ground iron ore at the time of granulation, said additive reacting with iron ore to form a compound which has a melting point lower than the preheating temperature.

According to the process of the present invention, iron ore powder is incorporated with an additive (or sintering auxiliary) which, upon reaction with iron ore, forms a compound which has a melting point lower than the preheating temperature. This additive permits iron ore powder to undergo liquid phase sintering while green pellets are being preheated. During preheating, the additive reacts with iron ore to give a low-melting compound which forms a liquid phase at the point of contact between particles of iron ore powder. This liquid phase bonds together the particles of iron ore powder. As the liquid-phase sintering advances, reaction of the low-melting compound with iron ore takes place through mutual diffusion. Eventually, the liquid phase turns into a high-melting compound and disappears. Thus the liquid-phase sintering completes, imparting strength to the preheated pellets.

The liquid-phase sintering of iron ore gives rise to the preheated pellets with improved strength, which hardly break in the subsequent firing step in the rotary kiln. Hence, the resulting fired pellets possess good characteristic properties (reducibility and crushing strength) for their satisfactory use in the blast furnace. The preheated pellets with improved strength contribute to yields in firing by the rotary kiln and also prevents the occurrence of kiln rings during firing.

As mentioned above, the process of the present invention employs an additive in the production of iron ore pellets. This additive is one which, upon reaction with iron ore, forms a compound having a melting point lower than the preheating temperature. To be more specific, this additive is an acmite-based compound (such as those represented by $Fe_2O_3$—$Na_2O$—$SiO_2$ and $Na_2O$—$SiO_2$).

Acmite-based compound is a generic name given to those compounds represented by $Fe_2O_3$—$Na_2O$—$SiO_2$ and $Na_2O$—$SiO_2$ which, upon reaction with $Fe_2O_3$ in iron ore, give an acmite compound. An acmite compound has a melting point lower than the preheating temperature (say, 1000° C.) depending on its composition ($Na_2O.Fe_2O_3.4SiO_2$) which may vary broadly. It may have a melting point as low as 760° C. if it has the composition denoted by point (c) in FIG. 2. These acmite-based compounds react with $Fe_2O_3$ in iron ore to give low-melting acmite compounds which form a liquid phase at the point of contact between iron ore particles. The liquid phase bonds iron ore particles together. These compounds used as an additive permit liquid phase sintering of iron ore powder to be performed easily during the preheating of green pellets.

The additive to be used in the production of iron ore pellets according to the present invention should preferably be soluble in water. When added to iron ore powder, the additive in the form of aqueous solution wets the surface of iron ore powder uniformly and certainly. Therefore, the additive keeps coating iron ore powder uniformly after the drying step and hence performs the liquid phase sintering efficiently. Consequently, the water-soluble additive will produce the same effect with a less amount than the water-insoluble one.

The water-soluble additive to be used in the production of iron ore pellets according to the present invention should preferably be sodium silicate ($Na_2O$—$SiO_2$-based compound). Sodium silicate is readily soluble in water, and hence it is easy to adjust the concentration of additive solution.

Sodium silicate that can be used in the present invention includes not only sodium metasilicate $Na_2SiO_3$ anhydride but also sodium orthosilicate ($Na_4SiO_4$) anhydride. When dissolved in water, these anhydrides hydrolyze to give sodium polysilicate such as $Na_2Si_2O_5$ and $Na_2Si_4O_9$, which can also be used as the additive.

The process of the present invention may be adequately applied to the production of iron ore pellets from iron ore with a high content of crystal water. To be more specific, the content of crystal water may be higher than 5.0 mass %, and the iron ore for pellet production may contain such high-water iron ore in an amount of 5–100 mass %, preferably 5–50 mass %, and more preferably 5–30 mass %. The process of the present invention permits the production of preheated pellets with improved strength from iron ore with a high content of crystal water by using the existing grate kiln facility without increasing the amount of energy for preheating.

The invention will be described in more detail with reference to the following examples in conjunction with the accompanying drawings.

EXAMPLE 1

Figure 2:
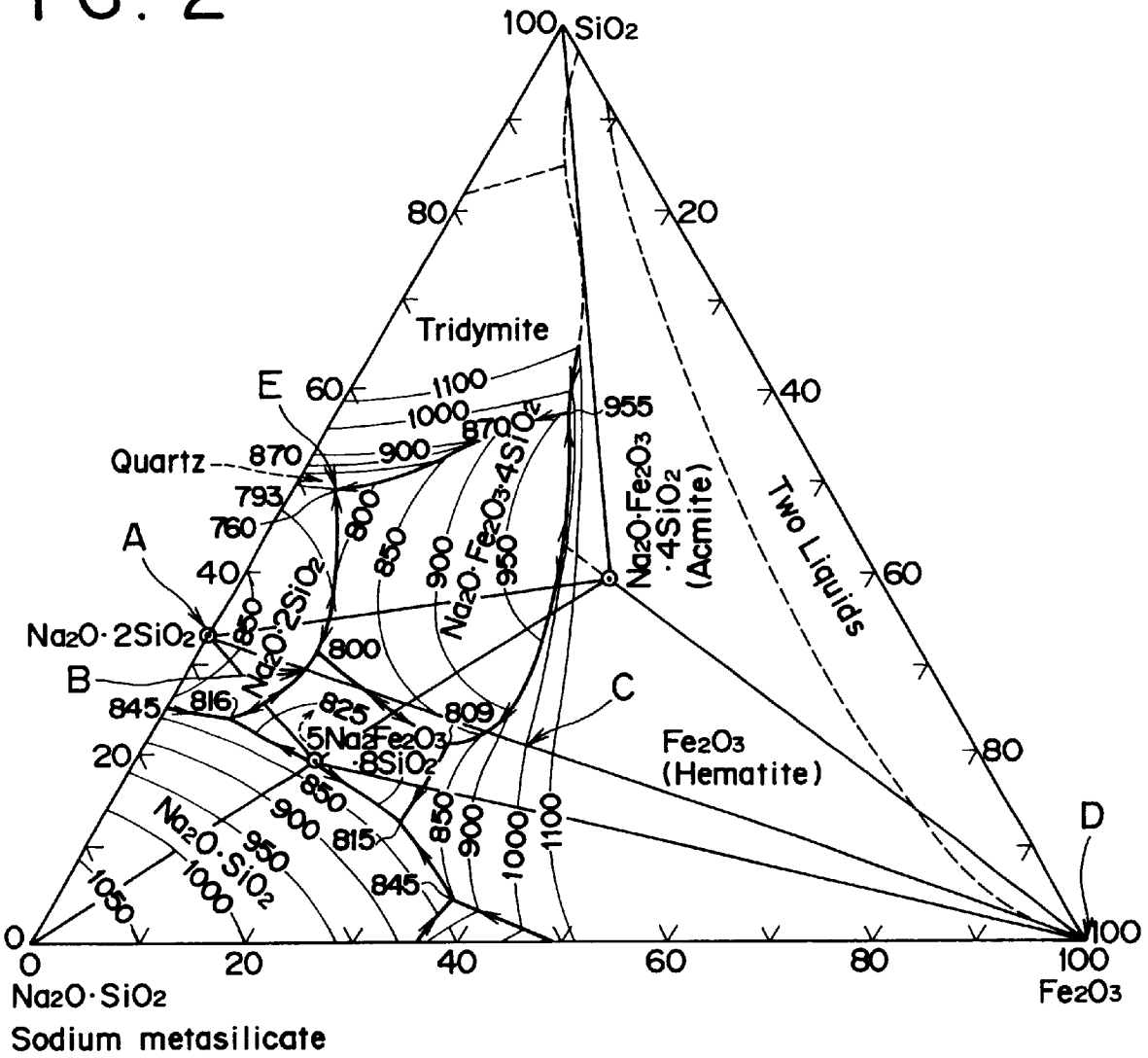
FIG. 2 is a ternary phase diagram of $SiO_2$—$Fe_2O_3$—$Na_2O.SiO_2$ system.

FIG. 1 illustrates the liquid-phase sintering of iron ore powder in this example. Part (a) of FIG. 1 shows iron ore particles in green pellets in the dry state after incorporation with the additive. Part (b) of FIG. 1 shows iron ore particles which have undergone liquid-phase sintering. FIG. 2 is a ternary phase diagram of $SiO_2$—$Fe_2O_3$—$Na_2O.SiO_2$.

Green pellets were prepared in the following manner from iron ore powder by liquid phase sintering at the time of preheating. First, iron ore powder (indicated by E in Table 2) having an average particle diameter of 50 $\mu$m was prepared from iron ore R with a high content of crystal water (20 mass %), iron ore H (24 mass %), and iron ore M (45 mass %). This iron ore powder was incorporated with an additive (0.08 mass %) which is powdery sodium metasilicate ($Na_2SiO_3$: $Na_2O.SiO_2$) dissolved in water. The resulting green pellets had a particle diameter of 9.5–11 mm and a porosity of about 28%. They were dried at 110–180° C. and then heated in the air at 1000° C. for 10 minutes by using an electric furnace such that the iron ore powder in the dry pellets underwent liquid phase sintering. The resulting pellets were used in this example.

TABLE 1

(mass %)

| Iron ore as raw material | $SiO_2$ | $Al_2O_3$ | Crystal water | T. Fe |
|---|---|---|---|---|
| Iron ore with a high content of crystal water (R) | 5.6 | 2.7 | 9.0 | 57.2 |
| Iron ore from Australia (H) | 4.2 | 2.5 | — | 62.8 |
| Iron ore from South Africa, mixed (M) | 1.4 | 0.3 | — | 69.5 |

TABLE 2

(mass %)

| | Designation of samples | | | | |
|---|---|---|---|---|---|
| Raw materials | A | B* | C | D | E* |
| Sodium silicate | — | 0.08 | — | 0.008 | 0.08 |
| Iron ore (R) | 7 | 7 | 20 | 20 | 20 |
| Iron ore (H) | 36 | 36 | 24 | 24 | 24 |
| Iron ore (M) | 45 | 45 | 45 | 45 | 45 |

The remainder is flux etc.
*Samples pertaining to the present invention.

In this example, the iron ore powder was incorporated with an aqueous solution of sodium metasilicate and made into green pellets by granulation. The sodium metasilicate added hydrolyzes according to the reaction formula below.

$$Na_2SiO_3+H_2O \rightarrow Na_2Si_2O_5+2NaOH$$

The resulting hydrolyzate is polysodium silicate ($Na_2Si_2O_5$) in the form of aqueous solution. This polysodium silicate ($Na_2Si_2O_5$:$Na_2O.2SiO_2$) corresponds to point (a) in FIG. 2 which is a ternary state diagram of $SiO_2$—$Fe_2O_3$—$Na_2O.SiO_2$.

The thus obtained green pellets are subsequently dried, so that the iron ore powder in the dried pellets is coated with polysodium silicate mentioned above. The polysodium silicate stays at the point of contact between iron ore particles. (Probably, this is due to the surface tension of the aqueous solution of polysodium silicate and the subsequent concentration of the aqueous solution at the time of drying.) This polysodium silicate functions as an auxiliary for liquid-phase sintering of iron ore powder.

The liquid-phase sintering of the dried pellets takes place as explained below with reference to FIG. 1 (part a) and FIG. 2. As the dried pellets are preheated (up to 1000° C.), polysodium silicate (indicated by point (A) in FIG. 2) collects at the point of contact between iron ore particles, and $Na_2O$ and $SiO_2$ constituting the polysodium silicate undergo solid-phase diffusion into iron ore particles and $Fe_2O_3$ constituting iron ore undergoes solid-phase diffusion into polysodium silicate. In other words, they undergo mutual diffusion.

When the temperature of the dried pellets reaches about 900° C., those which have undergone mutual diffusion melt to give a liquid phase (as indicated by 3 in FIG. 1). This is the outset of the liquid-phase sintering of iron ore powder. At this time, the liquid phase reacts with $Fe_2O_3$ in iron ore, with the composition of the liquid phase shifting from point (A) to point (B) in FIG. 2. Thus, the liquid phase decreases in melting point and increases in amount, causing the liquid-phase sintering of iron ore powder to advance further. This stage is accompanied by the formation of acmite compound.

The above-mentioned stage is followed by the diffusion of $Fe_2O_3$ into the liquid phase, and the composition of the liquid phase shifts from point (C) in FIG. 2 toward point (D) in FIG. 2. As the result, the melting point of the liquid phase increases and finally exceeds 1000° C. At this stage, the liquid phase disappears and the liquid-phase sintering is completed.

Preheating for the dried pellets continues at 1000° C., so that the solid-phase sintering of iron ore powder advances, with the result that $Na_2O$ and $Sio_2$ in the liquid phase diffuses into $Fe_2O_3$ in the iron ore.

As the preheating proceeds (up to 250–400° C.), the iron ore with a high content of crystal water undergoes thermal decomposition, losing its crystal water. This leads to shrinkage and an increase in porosity, creating a state in which iron ore particles hardly bond together. (Note that the iron ore used in this Example contains 20 mass % of iron ore with a high content of crystal water.)

When the temperature of the dried pellets reaches about 900° C., the part which has undergone mutual diffusion melts to form a liquid phase and the liquid-phase sintering takes place at the part where iron ore particles (on any kind) are in contact with one another. This forms a "bridge" which connects iron ore particles to each other. In this way, iron ore particles are bonded together firmly and the preheated pellets increase in strength.

Owing to the liquid-phase sintering and the ensuing solid-phase phase sintering, the preheated pellets in this Example have a crushing strength of 21 kg per pellet. This value is higher than the strength compensation value (20 kg per pellet or above) of preheated pellets obtained by preheating dried pellets in an electric furnace. Incidentally, conventional preheated pellets have a crushing strength of 13 kg per pellet (which is not satisfactory) if they are prepared from iron ore mixed with 20 mass % of high-water iron ore.

The part where the liquid phase had occurred was observed under an optical microscope. Acmite was not found in the sintered structure, and the segregation of the polysodium silicate added to the iron ore powder was not found. A probable reason for this is that $Na_2O$ and $SiO_2$ (at the part where the liquid phase has occurred) diffuse into $Fe_2O_3$ in the iron ore, and the amount of the sodium silicate added is so small (0.08 mass %).

The foregoing demonstrates that the additive in a very small amount greatly contributes to the strength of preheated pellets and the additive forms no segregated structure.

EXAMPLE 2

In this example, experiments were carried out with iron ore, in which the ratio of iron ore with a high content of crystal water was varied, and sodium metasilicate as the additive, whose amount was varied, by using an actual travelling grate. The iron ores used in this example are shown in Table 1, and they were mixed in a certain ratio as shown in Table 2. The mixed iron ores were made into green pellets having a particle diameter of 9.5–11 mm and a porosity of about 28%.

Samples A and B of green pellets contain 7 mass % of iron ore with a high content of crystal water. (This amount is the maximum limit of high-water iron ore that can be mixed by the conventional technology). Samples C, D, and E of green pellets contain 20 mass % of iron ore with a high content of crystal water. Samples B and E of green pellets accords with the present invention.

Green pellets of each sample were placed in an iron basket, and the basket was buried in the pellet layer (300 mm thick) in an actual travelling grate. In this test, those pellets in the lower part (100 mm from the bottom of the pellet layer) were used, because they are slow in temperature rise and hence their preheating time is short and the resulting preheated pellets are poor in strength. (Remember that heat exchange between the pellet layer and the preheating gas takes place at the upper layer first.)

In the experiment with an actual travelling grate, the lower pellets recorded a preheating temperature of 1000° C. and a preheating time of 10 minutes.

After drying, dehydration, and preheating by an actual travelling grate, the resulting preheated pellets in the lower part were tested for crushing strength. The results are shown in FIG. 3.

Figure 3:
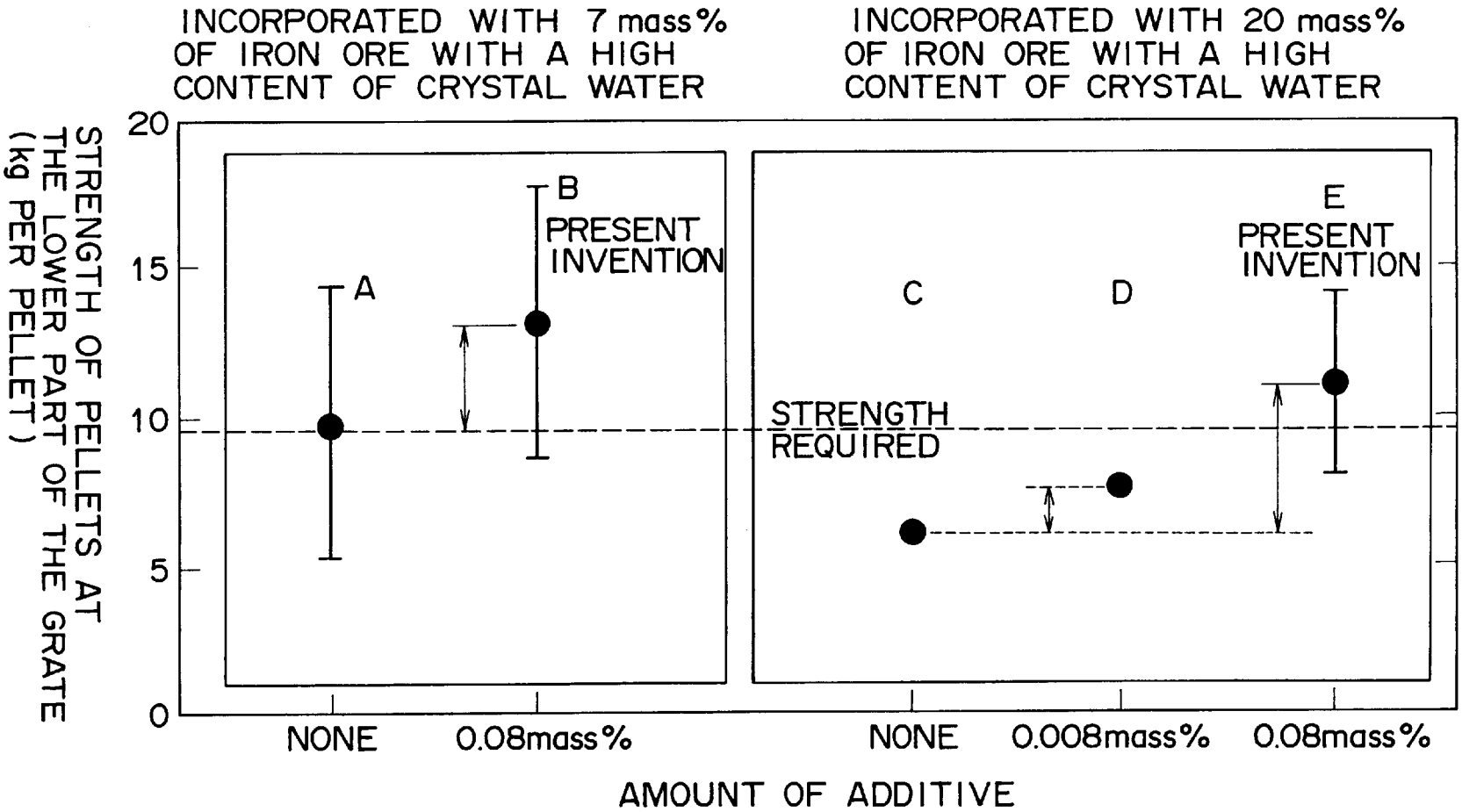
FIG. 3 is a diagram showing the results of the test of preheated pellets for crushing strength which was carried out by using an actual travelling grate.

It is apparent from FIG. 3 that the additive (sodium metasilicate) improves the strength of the preheated pellets. The preheated pellets incorporated with 0.08 mass % of sodium metasilicate have a higher crushing strength by about 3–5 kg per pellets than those without it.

It is noted that Sample B (which accords with the present invention) has a crushing strength which is higher by about 3 kg per pellet than required in actual operation (about 10 kg per pellet). Sample B contains 7 mass % of high-water iron ore. According to the conventional technology, 7 mass % has been regarded as the maximum amount of high-water iron ore that can be added to ordinary iron ore. This result suggests the possibility of improving productivity of preheated pellets by reduction of preheating time.

Even though the ratio of high-water iron ore is 20 mass % as in the case of Example E (which accords with the present invention), the resulting preheated pellets have a high crushing strength higher than necessary in actual operation. This suggests that preheated pellets containing 20 mass % of high-water iron ore can be used contrary to conventional practice.

The foregoing results show that the process of the present invention permits preheated pellets to be produced from raw materials incorporated with 5–30 mass % of iron ore containing more than 5.0 mass % of crystal water, by using the existing grate kiln, without the necessity of increasing preheating energy, and the thus produced preheated pellets have improved strength.

According to the process of the present invention, preheated pellets with improved strength are obtained by the liquid-phase sintering of iron ore powder. This effect is produced even though the amount of iron ore containing more than 5.0 mass % of crystal water varies over a broad range up to 100 mass %, preferably up to 50 mass %.

The preheated pellets obtained as mentioned above have a higher crushing strength than necessary in actual operation; therefore, they withstand tumbling firing in a rotary kiln, without becoming powder and causing kiln ring. This leads to improved yields.

The preheated pellets obtained by using an actual travelling grate were heated in the air at 1200–1230° C. for 10 minutes by using an electric furnace. The resulting pellets were used as samples in this example. (They are assumed to be finished products obtained by firing in a rotary kiln.)

The samples were tested for porosity, crushing strength, reducibility RI, and degradation by reduction RDI. The results are shown in Table 3.

TABLE 3

| Characteristic properties | Designation of samples | | | | |
|---|---|---|---|---|---|
| | A | B* | C | D | E* |
| Porosity (%) | 26.2 | 26.1 | 26.8 | 27.2 | 26.5 |
| Crushing strength (kg per pellet) | 240 up | 240 up | 240 up | 240 up | 240 up |
| Reducibility RI (%) | 80.0 | 80.0 | 82.3 | 83.5 | 80.2 |
| Degradation by reduction RDI (%) | 2.0 | 1.8 | 1.9 | 1.9 | 1.8 |

*Samples pertaining to the present invention.

It is noted from Table 3 that Sample E pertaining to the present invention has a slightly higher porosity than Sample A of conventional technology but is almost comparable to Sample A in crushing strength (higher than 240 kg per pellet) and reducibility RI and degradation by reduction RDI. In other words, it was found that the strength of finished pellets is not affected by porosity.

Sample E pertaining to the present invention showed an increase in alkali which is about 0.004 mass % of finished pellets. This amount has no significant effect on degradation by reduction RDI.

Incidentally, samples C and D have pellet characteristics similar to those of sample A because they were produced by firing preheated pellets in their resting state by using an electric furnace. The preheated pellets from which samples C and D were produced have such low strength that they do not withstand tumbling firing in the rotary kiln.

In this example, reducibility RI was measured according to JIS M8713 (1977) (Method of testing reducibility of iron ore) and degradation by reduction RDI was tested according to the method mentioned in "Seisen Hadobukku" (Handbook of pig iron production), p.319–320, by A. Shigemi, Issued by Chijin Shokan, December 1979). The test method consists of reducing finished pellets at 550° C. for 30 minutes, tumbling reduced pellets in a rotator as many times as prescribed, sieving pellets, and collecting powder that has passed through a 3-mm screen. The result is expressed in terms of per cent calculated by dividing the weight of powder by the weight of original pellets.

Figure 4:
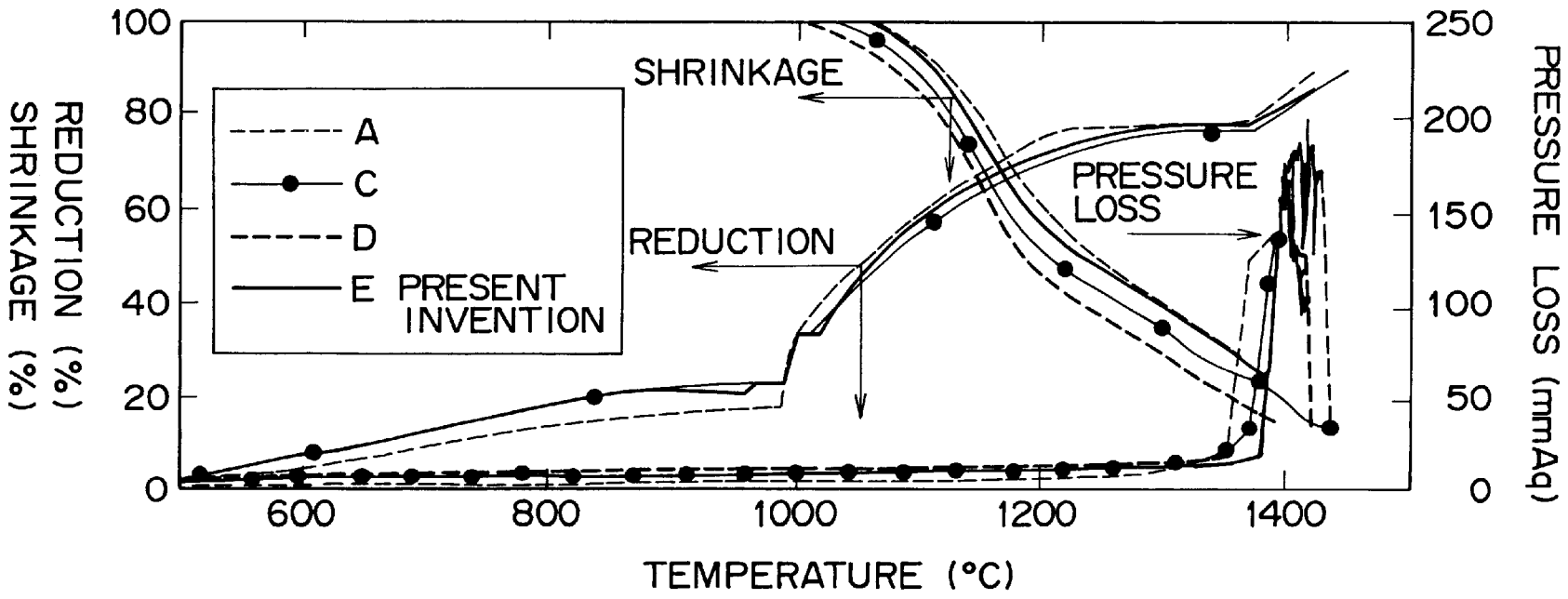
FIG. 4 is a diagram showing the results of the test for reduction under load which was performed on the sample pertaining to the present invention.

Furthermore, the samples were tested for reduction under load which simulates operation in the blast furnace. The results are shown in FIG. 4. It is apparent from FIG. 4 that Sample E (pertaining to the present invention) does not greatly differ from Sample A in behavior (such as reduction, shrinkage, and pressure loss). This suggests that pellets of Sample E can be used satisfactorily for the blast furnace.

Incidentally, the test for reduction under load was carried out according to the method mentioned in the above-mentioned handbook p. 315–318. The test method consists of heating sample pellets under load in a reducing gas. The heating rate, gas flow rate, and gas composition are prescribed. The sample pellets are examined for reducibility, shrinkage, and breathability (pressure loss).

As mentioned above, the process of the present invention yields preheated pellets which have a higher crushing strength than necessary for actual operation and hence withstand tumbling firing in the rotary kiln without breaking into powder. After complete firing in the rotary kiln, the preheated pellets become finished pellets having desirable characteristics such as reducibility, degradation by reduction, and crushing strength).

EXAMPLE 3

First, samples of green pellets were prepared from iron ore with a high content of crystal water and sodium silicate solution as the additive, both in varied amounts as shown in Table 4. (The sodium silicate solution was prepared by diluting thick water-glass with water.) Then, the green pellets were dried, dehydrated, and preheated by using an actual travelling grate. The production conditions of the green pellets and the operating conditions of the travelling grate are the same as those in Example 2.

The preheated pellets were recovered from the port (at the lower pellet layer) of the actual travelling grate, and they were tested for crushing strength.

TABLE 4

| | Designation of Examples | | | | |
|---|---|---|---|---|---|
| | F* | G | H | I | J |
| Sodium silicate (mass %) | — | 0.03 | 0.03 | 0.03 | 0.05 |
| Iron ore with a high content of crystal water (mass %) | 10 | 10 | 15 | 20 | 20 |
| Increase in crushing strength of preheated pellets (kg per pellet) | — | 3.5 | 2.0 | 0.5 | 1.5 |

*Comparative Example

"Increase in crushing strength of preheated pellets" = "Crushing strength of preheated pellets of Example" – "Crushing strength of preheated pellets of Comparative Example"

It is apparent from Table 4 that all the samples of preheated pellets incorporated with sodium silicate according to the present invention are higher in crushing strength than preheated pellets in Comparative Example. It is also noted that if the amount of sodium silicate is the same (0.03 mass %), the increase in crushing strength of preheated pellets becomes less as the ratio of high-water iron ore increases. It is also noted that if the ratio of high-water iron ore is the same (20 mass %), the increase in crushing strength of preheated pellets increases as the amount of sodium silicate increases. This suggests that the strength of preheated pellets will be higher than a certain level as the ratio of high-water iron ore increases or the amount of additive (sodium silicate) increases.

All the samples of preheated pellets produced in this example have a crushing strength higher than a certain level, and they withstood tumbling firing in the rotary kiln without breaking into powder. The resulting fired pellets were satisfactory for use in a blast furnace under ordinary conditions.

The process for producing iron ore pellets according to the present invention is characterized in that the raw materials are incorporated with sodium silicate (as a sintering auxiliary) so that iron ore powder undergoes liquid-phase sintering at the time of preheating, although sodium silicate (containing alkali metal) was believed to be detrimental to blast furnace operation. The resulting preheated pellets have improved strength.

In addition, the process for producing iron ore pellets according to the present invention is characterized in that the amount of sodium silicate (as an additive) can be reduced. This lessens the adverse effect of alkali metal in blast furnace operation. Sodium silicate (which is readily soluble in water) can be used in the form of aqueous solution, so that iron ore powder is coated with sodium silicate when dried. Such coated iron ore powder undergoes liquid-phase sintering efficiently with a small amount of sodium silicate.

According to the present invention, the amount of sodium silicate should be varied properly depending on the ratio of high-water iron ore. If the amount of sodium silicate is more than 0.01 mass %, the iron ore powder undergoes liquid-phase sintering sufficiently at the time of preheating. Therefore, in the case where the ratio of high-water iron ore is low (e.g., 5–10 mass %), the resulting preheated pellets will have a sufficiently high crushing strength.

Since the strength of preheated pellets increases as the amount of sodium silicate increases, it is desirable to increase the amount of sodium silicate as the ratio of high-water iron ore increases. On the other hand, preheated pellets become poor in degradation by reduction as the amount of alkali metal increases; therefore, the upper limit of the amount of sodium silicate should be 1.0 mass %, preferably 0.5 mass %, more preferably 0.3 mass %.

The sodium silicate that can be used in the present invention includes sodium metasilicate $Na_2SiO_3$ and sodium orthosilicate $Na_4SiO_4$ in the form of anhydride. These silicates may be used in the form of polysodium silicate (such as $Na_2Si_2O_5$ and $Na_2Si_4O_3$) as a hydrolyzate thereof.

The process of the present invention is not restricted to the one shown in Examples. The additive may be any compound which reacts with iron ore and has a melting point lower than the preheating temperature. Such a compound includes acmite compounds (represented by $Fe_2O_3$—$Na_2O$—$SiO_2$ and $Na_2O$—$SiO_2$) and phosphate compound (such as sodium phosphate and calcium dihydrogenphosphate).

The additive to be used in the present invention may be one which is not soluble in water. For example, the additive in the form of fine powder (with a particle size smaller than 10 $\mu$m) may be incorporated into iron ore powder. Alternatively, the additive (in the form of powder or solid) may be previously mixed with iron ore and the resulting mixture is crushed.

In the process of the present invention, the preheating temperature for dried pellets may be properly selected according to the characteristic properties of preheated pellets. It is usually 700–1050° C.

[Effect of the Invention]

As mentioned above, the first aspect of the present invention comprises adding an additive to iron ore powder at the time of granulation, said additive reacting with iron ore to form a compound which has a melting point lower than the preheating temperature, so that the iron ore powder undergoes liquid-phase sintering. The resulting preheated pellets have improved crushing strength and hence can be sufficiently fired, without breaking into powder, in the subsequent firing in the rotary kiln. Those pellets produced in this way have good characteristic properties (reducibility, degradation by reduction, and crushing strength) which are necessary for their use in the blast furnace.

The preheated pellets with improved crushing strength realize improved yields and prevent the occurrence of kiln rings during firing in the rotary kiln.

The second aspect of the present invention comprises using as the additive an acmite compound (represented by $Fe_2O_3$—$Na_2O$—$SiO_2$ or $Na_2O$—$SiO_2$). This acmite compound reacts with $Fe_2O_3$ in iron ore to give a compound which has a low melting point. This low-melting compound forms a liquid phase at the point of contact between iron ore particles, permitting the liquid-phase sintering of iron ore particles.

The third aspect of the present invention comprises employing an aqueous solution of sodium silicate (by utilizing the property that sodium silicate is readily soluble in water). The aqueous solution of sodium silicate uniformly and certainly wets the surface of the iron pore powder. Therefore, sodium silicate uniformly and certainly covers iron ore powder after the drying step. This permits the efficient liquid-phase sintering of iron ore powder. Coating iron ore powder with sodium silicate leads to the reduction of sodium silicate to be added. This makes it possible to reduce the production cost of iron ore pellets without subjecting finished pellets to degradation by reduction.

The fourth aspect of the present invention comprises producing pellets from raw materials incorporated with a large amount of high-water iron ore by using the existing grate kiln facility without increasing fuel for preheating, the resulting preheated pellets having improved strength.

What is claimed is:

1. A process for producing fired pellets, the process comprising granulating a mixture of iron ore and an additive to form green pellets;

drying the green pellets to form dried green pellets;

preheating the dried green pellets at a preheating temperature in a range of from 700–1050° C. to form preheated pellets, the preheating causing the additive to react with the iron ore to form a compound having a melting point lower than the preheating temperature; and firing the preheated pellets at a temperature above the preheating temperature.

2. The process as defined in claim 1, wherein the additive is an acmite compound.

3. The process as defined in claim 1, wherein the additive is sodium silicate.

4. The process as defined in claim 1, wherein the iron ore comprises 5–100 mass % of at least one iron bearing compound containing more than 5.0 mass % of water.

* * * * *

UNITED STATES PATENT AND TRADEMARK OFFICE

CERTIFICATE OF CORRECTION

PATENT NO. : 6,241,808 B1
DATED : June 5, 2001
INVENTOR(S) : Morioka et al.

It is certified that error appears in the above-identified patent and that said Letters Patent is hereby corrected as shown below:

Title page,
Item [73], the Assignee's name should read as follows:

-- [73] Assignee: Kabushiki Kaisha Kobe Seiko Sho (Kobe Steel, Ltd.,) Kobe (JP) --

Signed and Sealed this

Ninth Day of April, 2002

*Attest:*

*Attesting Officer*

JAMES E. ROGAN
*Director of the United States Patent and Trademark Office*